US005789863A

United States Patent [19]

Takahashi et al.

[11] Patent Number: 5,789,863

[45] Date of Patent: Aug. 4, 1998

[54] SHORT ARC LAMP WITH ONE-PIECE CATHODE SUPPORT COMPONENT

[75] Inventors: Masanori Takahashi; Akihiko Sugitani; Hideo Tanaka, all of Himeji, Japan

[73] Assignee: Ushiodenki Kabushiki Kaisha, Tokyo, Japan

[21] Appl. No.: 727,165

[22] Filed: Oct. 7, 1996

[30] Foreign Application Priority Data

Oct. 6, 1995 [JP] Japan ..... 7-284399

[51] Int. Cl.[6] ..... H01J 1/96

[52] U.S. Cl. ..... 313/623; 313/113; 313/285

[58] Field of Search ..... 313/623, 624, 313/634, 113, 32, 285, 283

[56] References Cited

U.S. PATENT DOCUMENTS 3,644,768 2/1972 McRae ..... 313/113
3,657,588 4/1972 McRae ..... 313/113
3,808,496 4/1974 McRae et al. ..... 313/113
4,658,179 4/1987 Roberts ..... 313/634

*Primary Examiner*—Sandra L. O'Shea
*Assistant Examiner*—Joseph Williams
*Attorney, Agent, or Firm*—Sixbey, Friedman, Leedom & Ferguson; David S. Safran

[57] ABSTRACT

A short arc lamp in which welding of a cathode to a conductive support component yields an advantageous connection of the cathode to the conductive support component in which the thermal influences are reduced, and in which the cathode tip does not move. The short arc lamp has a body within which a concave discharge space is formed, an anode and a cathode are located in the concave discharge space, a conductive support component for supporting the cathode is connected to a feeding ring which is located in the vicinity of an open end of the reflection surface, a first metal component which is formed on one end of the body, and a second metal component which is formed on the other end of the body. In a preferred embodiment, only a single conductive support component is welded to the cathode.

3 Claims, 3 Drawing Sheets

SHORT ARC LAMP WITH ONE-PIECE CATHODE SUPPORT COMPONENT

BACKGROUND OF THE INVENTION

1. Field of the Invention

The invention relates to a short arc lamp which is widely used for applications in which parallel light from a strong point light source is used, as for a projector, a spectrometer and the like, and for applications in which light from a strong point light source is focussed on a very small surface, and in which illumination and heating are performed through optical fibers and the like.

2. Description of Related Art

In a short arc lamp, generally, ceramic, quartz glass or another glass material is used for the arc tube. For special applications, however, lamps are known in which the main part of the lamp is made of ceramic, which is an opaque insulating component and in which transparent ceramic is used only for the light exit part. This lamp has essentially a columnar overall exterior shape, is extremely stable, and can be easily handled. This short arc lamp is known, for example, from Japanese patent SHO 54 37436 or Japanese patent publication HEI 4-57065.

FIG. 5 is a schematic of an arrangement of one example of a conventional short arc lamp. In the drawing, reference number 1 labels a columnar body within which a concave discharge space D which has a curved reflection surface 1*a* is formed. In the vicinity of the reflection surface 1*a* is a feeding ring 2. Conductive support components 3, which support cathode 4 and position it in a predetermined position in discharge space D at a distance relative to anode 5, are welded by brazing to the feeding ring 2. This feeding ring 2 is attached by a first metal component 6 to body 1. Furthermore, a metal block 7 is attached by a second metal component 8 to body 1. Anode 5 is electrically connected within this metal block 7.

FIG. 6 is a schematic in which only the feeding ring 2 and the conductive support components 3 of the short arc lamp of FIG. 5 are shown. Cathode 4 is supported by three conductive support components 3 in a stipulated position of discharge space D and they are located essentially at the same distances to one another on the circular periphery of feeding ring 2. These conductive support components 3 are brazed to the cathode 4 and also to the feeding ring 2 by brazing filler metal, as shown in FIG. 6.

When the lamp is operating, the temperature of the back end of the cathode reaches roughly 1000° C., i.e., almost the melting point of the brazing filler metal. Furthermore, as a result of repeated turning off and on of the lamp, stress is exerted on the brazed sites by thermal shock, because cathode 4 and conductive support components 3 have different thermal expansion coefficients. In the final effect, cracks form in the brazed points and the brazing filler metal melts. Furthermore, here, there are the disadvantages that the cathode cannot be retained in the set position within the discharge space, and that the cathode tip which is opposite the anode 5 moves. This means that, due to the deviation of cathode 4 from the set position, the disadvantages arise that the optical characteristics deteriorate and that the amount of light emerging from the lamp decreases.

The above described disadvantages become more serious with time, because cathode 4 is supported by the three conductive support components 3 by brazing and because, therefore, complex stresses are exerted on the cathode 4 in three directions.

On the other hand, besides the disadvantages of crack formation in the brazing filler metal, the following disadvantages arise for the above described reasons and from the motion of the cathode tip due to melting of the brazing filler metal:

If cracks occur in the brazed points between conductive support components 3 and cathode 4, radiation of heat from cathode 4 via conductive support components 3 cannot be adequately achieved. As a result, the temperature of the brazing filler metal rises to excess in the locations in which cathode 4 is brazed to the conductive support components 3 and the brazing filler metal vaporizes.

This means that the disadvantages arise that these vaporized brazing filler metals adhere to the reflection surface or to the inside of the light exit window component, that as a result the optical characteristic deteriorates, and that the amount of light emerging from the lamp decreases.

SUMMARY OF THE INVENTION

In view of the above-described circumstances, a primary object of the present invention is to devise a short arc lamp in which welding a cathode to a conductive support component yields an advantageous connection of the cathode to the conductive support component in which the thermal influences of the cathode and of the conductive support component are reduced.

In connection with the foregoing object, it is a more specific object to avoid the exertion of stresses on the cathode, especially, by supporting the cathode via a single conductive support component so that the cathode tip does not move.

These objects are achieved according to the invention by the fact that, in a first embodiment, there is a short arc lamp which has a body formed of an insulating component, within which body a concave discharge space with a curved reflection surface is formed, a pair of electrodes which are located spaced to one another in the discharge space, roughly in the focal point of the reflection surface, and a feeding ring which is located in the vicinity of the reflection surface and to which a conductive support component is connected electrically to support one electrode of the pair of electrodes, the conductive support component extending in the discharge space in a radial direction of the feeding ring, and being welded to one of the electrodes.

The term "welding" is defined here as a connection which is established in the state in which the cathode and the conductive support component have been brought directly into contact with one another such that the immediate contact points melt together. For this reason emission of laser light, such as a YAG laser or the like, electron beam welding or plasma arc welding, can be used.

The short arc lamp, in accordance with a second feature of the invention, is characterized by the cathode being supported by being welded to a single conductive support component in the short arc lamp of the invention.

These and further objects, features and advantages of the present invention will become apparent from the following description and the accompanying drawings which, for purposes of illustration only, show a single embodiment in accordance with the present invention.

DETAILED DESCRIPTION OF THE PREFERRED EMBODIMENT

Figure 1:
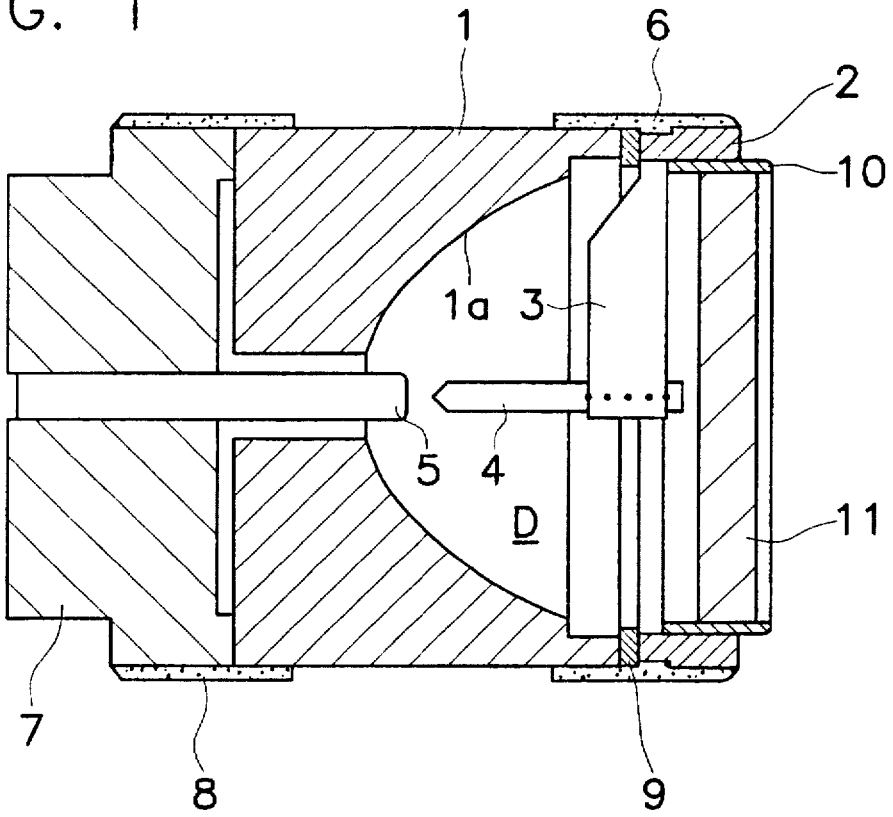
FIG. 1 is a cross-sectional view of an arrangement of one embodiment of the short arc lamp according to the invention.

FIG. 1 shows schematically the arrangement of one example of the short arc lamp according to the invention. In the drawing, body 1 is an insulating component made of aluminum oxide and has an outside diameter of about 30 mm. Within this body 1, a curved reflection surface 1*a* is formed. Reflection surface 1*a* can be made having a parabolic oval or nonspherical cross-sectional contour in order to obtain light output with high directivity. Reflection surface 1*a* of the illustrated short arc lamp is parabolic, and to increase its reflection efficiency, a metal, such as silver, aluminum, or the like, is vapor deposited on it. Instead of a metal vapor deposited film, a dielectric, multilayer film can also be positioned on surface 1*a*. A discharge space D is enclosed by reflection surface 1*a*. In the focal position of reflection surface 1*a*, a cathode 4 and an anode 5 are arranged spaced apart opposite one another, such that they lie coaxially with respect to the axis of reflection surface 1*a*. Cathode 4 and anode 5 are made of tungsten. The distance between the free end of cathode 4 and the facing free end of anode 5 is 1 to 2 mm. The tip of cathode 4 tapers at an angle of about 30° to 50° which is established to obtain advantageous electron emission.

One side of ceramic ring 9 has an outer diameter which is essentially the same as the outer diameter of body 1 and is placed against an end edge of body 1 which adjoins the open end of reflection surface 1*a*. The other side of ceramic ring 9 is provided via a copper ring (not shown) and a KOVAR® feeding ring 2 having an outer diameter which is, likewise, essentially identical to the outer diameter of body 1. Furthermore, a ring-shaped flange 10 is installed such that it borders the inside of the feeding ring 2. On its inner peripheral surface, flange 10 has a transparent circular window component 11 which if formed of sapphire, because it passes visible radiation and because its coefficient of thermal expansion is roughly identical to the coefficient of thermal expansion of the KOVAR® of feeding ring 2.

A first metal component 6 is made of KOVAR® and is positioned to attach feeding ring 2, and with it the flange 10 which is positioned adjoining its inner peripheral surface and window component 11, to the body 1. First metal component 6 has a width of roughly 10 mm and a thickness of roughly 1 mm. This means that by means of the first metal component 6, the feeding ring 2, flange 10 and window component 11, a hermetically enclosed state is maintained inside of discharge space D. First metal component 6 also acts as a feeding device to supply current to the cathode 4 via the feeding ring 2 and the conductive support component 3.

Conductive support component 3, with consideration of heat resistance and welding properties, is formed of molybdenum and extends within discharge space D in the radial direction of feeding ring 2. One end of the conductive support component 3 is welded to the feeding ring 2 and the other end to cathode 4. This means that the conductive support component 3 is a conductor for the current into cathode 4, and at the same time, component 3 supports cathode 4 in discharge space D, such that it is located in a stipulated position. This conductive support component 3 has a width of 4.0 mm and a thickness of 0.4 to 0.8 mm and is arranged such that its transverse direction becomes parallel to the lamp axis in order that reflection light from reflection surfaced 1*a* is not shielded.

Part of the metal block 7 has an outside diameter which corresponds essentially to that of the body 1 and is attached to the end of body 1 by a second metal component 8 which extends about their peripheries. Metal block 7 is penetrated in its center by anode 5, by which an electrical connection is effected. This means that the second metal component 8 also acts as a feeding device to supply current via metal block 7 to anode 5. Second metal component 8 has a width of roughly 8 mm and a thickness of about 1 mm. Metal block 7 also acts as a heat absorption body for the body 1 and prevents an excessive temperature increase within discharge space D. Metal block 7 is made, for example, of iron because, in this way, high electrical conductivity, and at the same time, heat absorption action can be achieved.

The short arc lamp is arranged in the above-described manner. This short arc lamp has a nominal current of 20 A and a power consumption of 300W. The discharge space D is filled with an inert gas, such as xenon or the like, with a pressure which is a few dozen times atmospheric pressure.

Figure 2:
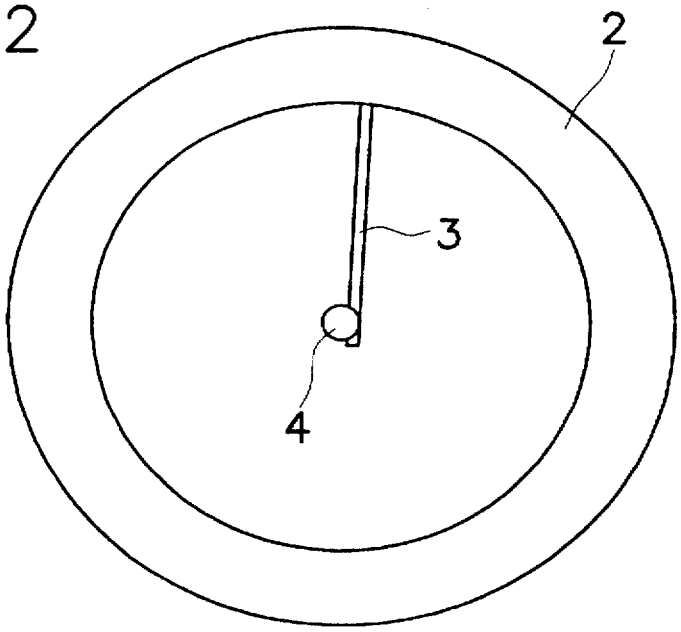
FIG. 2 is a plan view of a feeding ring and a conductive support component of the short arc lamp shown in FIG. 1.

FIG. 2 is a schematic in which only the feeding ring and conductive support component of the short arc lamp shown in FIG. 1 are illustrated. Cathode 4 is supported by a single conductive support component 3 in a predetermined position of the discharge space D. This conductive support component 3 is welded both to the feeding ring 2 and also to cathode 4. More precisely, cathode 4 is brought directly into contact with conductive support component 3, and conductive support component 3 with feeding ring 2, and in this state, YAG laser light is emitted and the two components are welded together by melting. Furthermore, the welding means is not limited to YAG laser light and, moreover, electron beam welding or plasma arc welding or the like can also be used.

Figure 3:
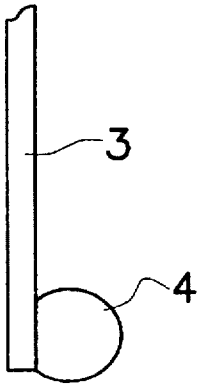
FIG. 3 shows an enlarged view of the connection of the cathode and the conductive support component of the short arc lamp shown in FIG. 1.
Figure 4:
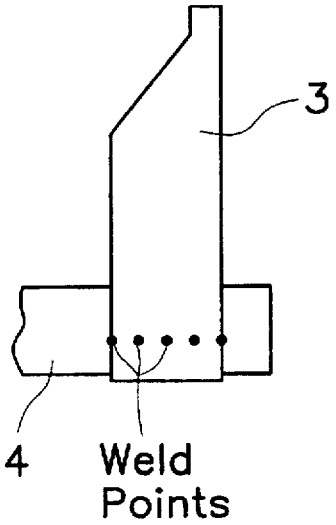
FIG. 4 shows a side view of the connection of FIG. 1.
Figure 5:
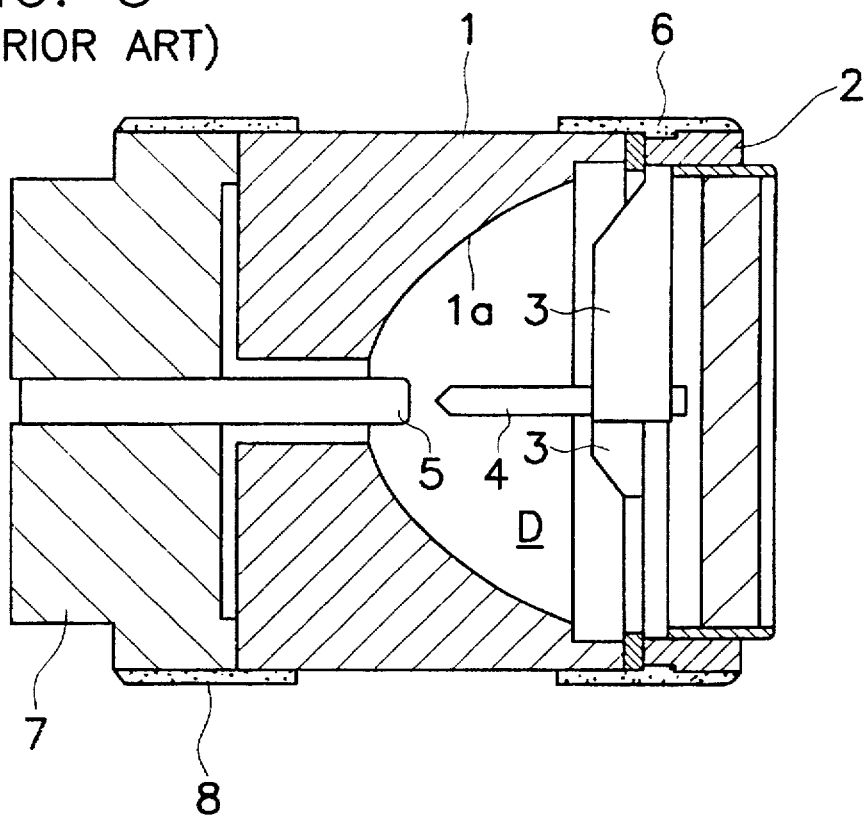
FIG. 5 (PRIOR ART)
FIG. 5 is a cross-sectional view of an arrangement of a conventional short arc lamp.
Figure 6:
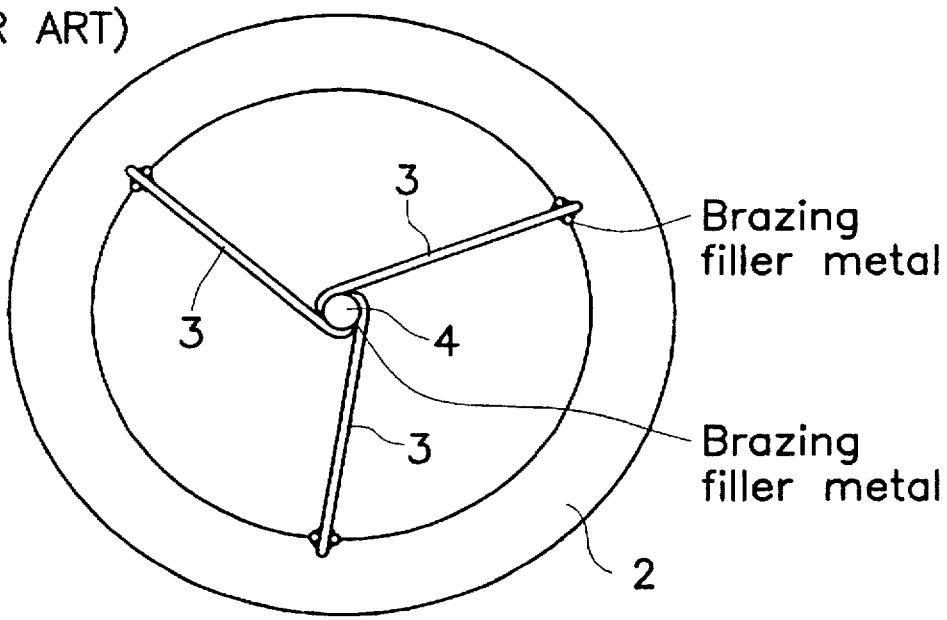
FIG. 6 (PRIOR ART)
FIG. 6 is a plan view of feeding ring and conductive support components of the short arc lamp shown in FIG. 5.

FIGS. 3 and 4 are schematics in which only the cathode and the conductive support component are shown. As is shown in FIG. 3, the side of cathode 4 which comes into contact with the conductive support component 3 has a flat part. Welding to cathode 4 is performed in a state in which conductive support component 3 has been brought into contact with this flat part, by emission of YAG laser light or the like.

As is illustrated in FIG. 4, cathode 4 and conductive support component 3 are welded to one another, in this example, at five points. However, this number of weld points can be varied by changes of the welding surfaces. The number of welding points is, therefore, not limited to five, because it depends only on what is required to weld cathode 4 and conductive supporting part 3 securely to one another.

By welding cathode 4 directly to conductive support component 3, the two melt at the connection points and form an integral arrangement. This means that, by welding the tungsten of cathode 4 to the molybdenum of conductive support component 3, at these weld points, the value which is defined by the ratio of the operating temperature of the connection points to the lowest melting point of the materials which form the connection points is less than for connection points of conventional brazing filler metal with a tungsten cathode and in the connection points of the brazing filler metal with molybdenum conductive support components. Therefore, mechanical resistance to thermal influences can be guaranteed even more and thus thermal resistance discretely increased.

Even if stress occurs due to thermal shocks, occurrence of metal fatigue, cracking and also vaporization of the weld points are prevented because mechanical strength is ensured by the above described relationship between the operating temperature and the melting point.

As a result of welding the cathode 4 to the conductive support component 3, heat resistance is increased relative to the conventional arrangement. Therefore, cathode 4 was enabled to be supported only by single conductive support component 3.

Conventionally, as a result of supporting the cathode by three conductive support components in the case in which stress was exerted on the respective conductive support component due to thermal influences, such as bending or the like, this stress could not be diminished anywhere, and stress due to thermal shocks occurred at the connection points of the cathode with the conductive support components. In the short arc lamp according to the invention, exertion of this stress is prevented because the cathode is supported by a single conductive support component. Therefore, the stress exerted on the weld points of the cathode on the conductive support component by thermal shocks can be largely reduced, by which the cathode in the discharge space can always be attached in a set position, and by which movement of the cathode tip is prevented.

Action of the Invention

In the short arc lamp according to the invention, by welding the cathode to the conductive support component and the conductive support component to the feeding ring, the respective weld point melts, by which an integral arrangement is obtained. This means that at these weld points the value at which the operating temperature is divided by the melting point temperature becomes less than in the conventionally brazed connection points. Therefore the mechanical resistance to thermal influences can be guaranteed even more and melting also avoided. Even when stress occurs due to thermal shocks, occurrence of metal fatigue, cracking and also vaporization of the welding points are prevented, because mechanical strength is guaranteed by the relationship between the operating temperature and the melting point.

According to the invention, moreover the cathode can be supported by a single conductive support component. In this way, the heat of the conductive support components cannot exert stress on the cathode, by which the cathode in the discharge space can always be attached in a set position, and by which movement of the cathode tip can be prevented.

It is to be understood that although a preferred embodiment of the invention has been described, various other embodiments and variations may occur to those skilled in the art. Any such other embodiments and variations which fall within the scope and spirit of the present invention are intended to be covered by the following claims.

What we claim is:

1. Short arc lamp comprising a body made of an insulating material and within which a concave discharge space with a curved reflection surface is formed, a pair of spaced, electrodes which are positioned in the discharge space approximately in a focal position of the reflection surface, and a feeding ring which is located in the vicinity of an opening end of the reflection surface and to which a conductive one-piece support component is connected electrically for supporting one of said pair of electrodes; wherein the conductive support component extends in the discharge space in a radial direction of the feeding ring; and wherein the conductive support component is welded to said one of said pair of electrodes.

2. Short arc lamp according to claim 1, wherein said one of said pair of electrodes which is welded to the conductive support component is a cathode.

3. Short arc lamp according to claim 1, wherein said one of said pair of electrodes is supported by only a single cantilevered arm of said conductive support component.

* * * * *